US009062547B2

(12) United States Patent
Craven et al.

(10) Patent No.: US 9,062,547 B2
(45) Date of Patent: Jun. 23, 2015

(54) EXPANDABLE BOLT WITH SHIELDED TIP

(75) Inventors: Arthur J. Craven, Grand Junction, CO (US); Daniel Leon Seegmiller, Sandy, UT (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/118,678

(22) Filed: May 31, 2011

(65) Prior Publication Data

US 2011/0299939 A1 Dec. 8, 2011

Related U.S. Application Data

(60) Provisional application No. 61/351,328, filed on Jun. 4, 2010.

(51) Int. Cl.
*E21D 21/00* (2006.01)

(52) U.S. Cl.
CPC ..... *E21D 21/0033* (2013.01); *E21D 2021/006* (2013.01)

(58) Field of Classification Search
CPC ..... E21D 2021/0073; E21D 21/004; E21D 2021/006; E21D 21/0033
USPC ..... 405/259.1, 259.3
See application file for complete search history.

(56) References Cited

U.S. PATENT DOCUMENTS

| | | | | |
|---|---|---|---|---|
| 4,129,007 | A * | 12/1978 | Rausch | 405/259.6 |
| 4,423,986 | A | 1/1984 | Skogberg | |
| 4,509,889 | A | 4/1985 | Skogberg et al. | |
| 4,601,614 | A * | 7/1986 | Lane et al. | 405/259.6 |
| 4,696,606 | A | 9/1987 | Herron | |
| 5,765,969 | A | 6/1998 | Kåreby et al. | |
| 5,997,219 | A * | 12/1999 | Krzysztalowicz et al. | 405/259.3 |
| 6,929,424 | B2 | 8/2005 | Hindle | |
| 6,935,811 | B2 | 8/2005 | Simmons et al. | |
| 7,004,686 | B2 | 2/2006 | Mocivnik et al. | |
| 7,377,724 | B2 | 5/2008 | Oberg et al. | |
| 7,896,580 | B2 | 3/2011 | Weaver et al. | |
| 7,927,043 | B2 | 4/2011 | Iwasaki et al. | |
| 2004/0161316 | A1 | 8/2004 | Locotos et al. | |

FOREIGN PATENT DOCUMENTS

| | | | |
|---|---|---|---|
| JP | 200190067 | A | 4/2001 |
| JP | 2003-148098 | A | 5/2003 |
| JP | 2006-219933 | A | 8/2006 |
| WO | 2005/073510 | A1 | 8/2005 |

* cited by examiner

*Primary Examiner* — Thomas B Will
*Assistant Examiner* — Katherine Chu
(74) *Attorney, Agent, or Firm* — The Webb Law Firm

(57) ABSTRACT

The present invention includes a rock bolt having a longitudinally expandable tube. The tube includes a longitudinally extending depression that defines a temporary enclosed longitudinal passageway. The rock bolt further includes a shielded distal end to prevent debris from entering the temporary enclosed longitudinal passageway. The distal end is shielded using a cover which may be a plug or a cap and may provide a rounded tip for the rock bolt. The plug may be spherical. The cap may be attached such that its proximal end abuts the distal end of the rock bolt, is inserted into the distal end of the rock bolt, or extends beyond the distal end and along the sidewall of the rock bolt. The present invention also includes a method of making such a rock bolt and a method of using such a rock bolt.

10 Claims, 3 Drawing Sheets

EXPANDABLE BOLT WITH SHIELDED TIP

CROSS REFERENCE TO RELATED APPLICATION

The present application claims priority to U.S. Provisional Patent Application No. 61/351,328, filed Jun. 4, 2010, entitled "Expandable Bolt with Shielded Tip", the entire disclosure of which is herein incorporated by reference.

BACKGROUND OF THE INVENTION

1. Field of the Invention

This invention relates to a rock bolt having an expandable tube and a shielded distal end, a method of making such a rock bolt, and a method of using such a rock bolt.

2. Description of Related Art

Rock bolts are used in underground mines, such as coal mines, to support the roof and ribs. Installation of conventional rock bolts involves drilling a borehole into the rock to a desired depth using an elongated drilling tool (termed the drill steel), removing the drill steel from the borehole, optionally inserting adhesive resin cartridges, and retaining the cartridges in the blind end of the borehole while a bolt, optionally bearing an expansion anchor, is installed into the borehole. The free end of the bolt extending out of the borehole is received by a chuck of a bolting machine. The bolting machine rotates the bolt within the borehole to mix the adhesive resin and/or expand the expansion anchor.

Other rock bolts comprise a longitudinally expandable tube that includes a longitudinally extending depression between two curved outer portions where the tube is partially collapsed on itself. The ends of the tube are folded over to create two enclosed cavities in the curved outer portions of the tube while a temporary passageway defined by the depression remains open on the ends. After placing the rock bolt in the pre-drilled borehole, pressurized fluid is delivered into the two cavities to force the depression outward, expand the tube, and compress it against the surrounding rock. Until the expansion has been completed, the ends of the passageway defined by the depression are open so that debris from the borehole can fall into the passageway defined by the depression.

SUMMARY OF THE INVENTION

The present invention includes a rock bolt having a longitudinally expandable tube. The tube includes a longitudinally extending depression that defines a temporary, enclosed longitudinal passageway. The rock bolt further includes a cover on the distal end of the rock bolt to prevent debris from entering the temporary, enclosed longitudinal passageway, ease insertion of the rock bolt into the borehole, and assist in alignment of the rock bolt in the borehole. The cover may be a plug or a cap and may provide a rounded tip for the rock bolt. The plug may be spherical. The cap may be attached such that its proximal end abuts the distal end of the rock bolt, is inserted into the distal end of the rock bolt, or extends beyond the distal end and along the sidewall of the rock bolt.

The present invention also includes a method of manufacturing a rock bolt, including providing an expandable member including an expandable tube and an end fitting where the expandable tube has a longitudinally extending depression disposed between a pair of outer portions of the tube, the exterior of the tube defines a temporary, enclosed longitudinal passageway having an open distal end, and the outer portions of the tube have closed distal ends; and enclosing the expandable member with a cover such that a distal open end of the temporary, enclosed longitudinal passageway of the expandable tube is covered. The cover may be a plug or a cap and may provide a rounded tip for the rock bolt. The method may also include placing a stiffening tube on a proximal end of the expandable tube such that the stiffening tube surrounds the proximal end of the expandable tube and has an opening that aligns with a corresponding opening in the expandable tube, thereby providing fluid communication to an interior of the expandable tube.

A method of using a rock bolt, including providing a rock bolt having an expandable member including an expandable tube having a temporary, enclosed longitudinal passageway with an open distal end; and a cover at a distal end of the rock bolt covering the temporary longitudinal passageway; drilling a borehole in rock; placing the rock bolt in the borehole; expanding the tube by providing pressurized fluid to the interior of the tube, thereby providing frictional engagement between an exterior of the tube and an interior of the borehole; and draining the fluid from the interior of the tube. The cover may be a plug or a cap and may provide a rounded tip for the rock bolt.

DETAILED DESCRIPTION OF THE INVENTION

Figure 1:
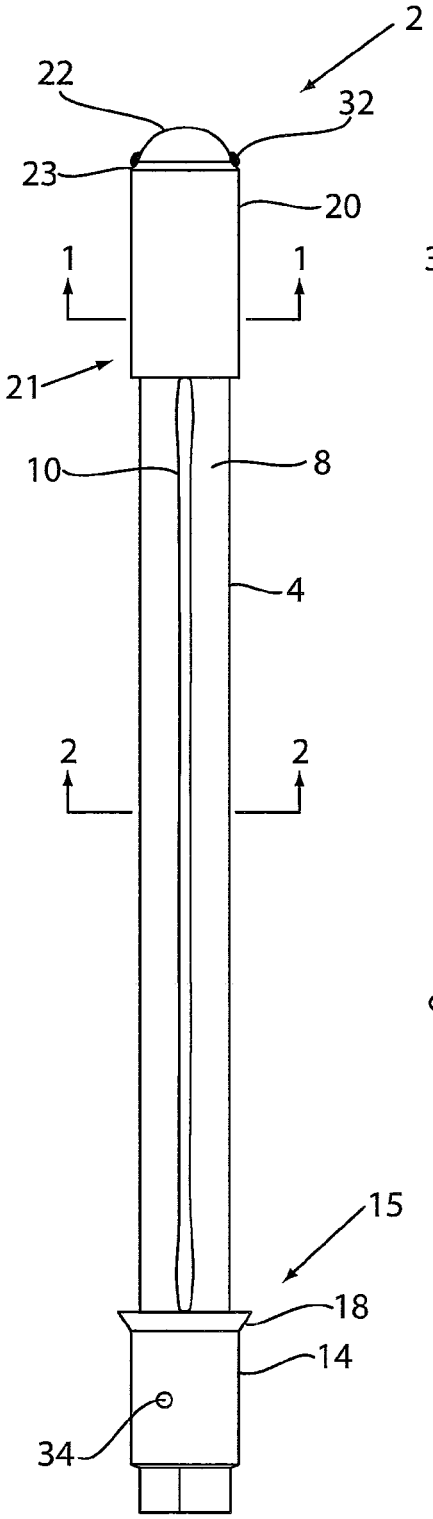
FIG. 1 is a side view of a rock bolt produced according to the present invention.
Figure 2:
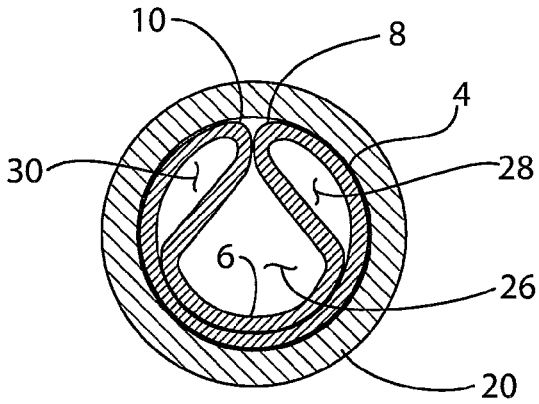
FIG. 2 is a cross-section taken along lines 1-1 of FIG. 1.

Referring now to the drawing figures in which like reference numbers refer to like elements, FIG. 1 shows a rock bolt 2 which includes an expandable tube 4 having an initial cross-sectional profile as shown in FIG. 2. The tube 4 is partially collapsed upon itself (such as by rolling or drawing) so as to provide a depressed region 6 between two curved outer portions 8, 10 extending longitudinally along the tube 4. The tube 4 is produced from a steel alloy or the like having sufficient strength to function in rock support, even after deformation from internal hydraulic pressure as described below. A first stiffening tube 14, having a sidewall and two open ends, is attached to and surrounds a proximal end 15 of the tube 4. A lip 18 may extend from stiffening tube 14 for engaging with a rock surface when the rock bolt 2 is inserted in the borehole.

A second stiffening tube 20, having a sidewall and two open ends, is attached to and surrounds a distal end 21 of tube 4 leaving the end of the tube 4 uncovered. A cover 22 covers the opening in a distal end 23 of second stiffening tube 20, the tube 4, or both and may be fixed thereto by welding or the like. The outer curved portions 8, 10 of tube 4 abut one another to define a temporary main passageway 26 as well as interior passageways 28, 30. Main passageway 26 is open at the distal end 21 of tube 4 while interior passageways 28, 30 are closed as shown in FIGS. 4-7. As shown in FIG. 1, the first stiffening tube 14 defines an opening 34 which is aligned with an opening (not shown) in tube 4, such that the openings are in fluid communication with interior passageways 28, 30.

Figure 3:
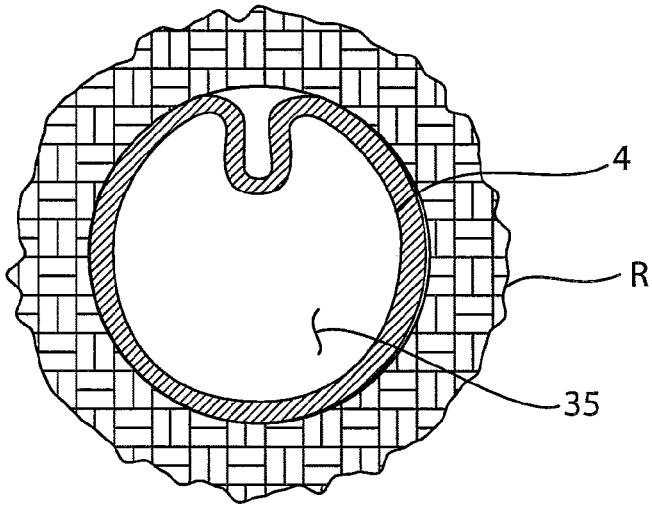
FIG. 3 is a cross-section taken along lines 2-2 of FIG. 1, as installed in rock strata.

In operation, a borehole is drilled into the rock to the desired depth and the bolt 2 is inserted through a bearing plate and into the borehole. A source of pressurized fluid, such as water, is delivered through the opening 34 of the first stiffening tube 14 and an opening in tube 4 into interior passageways 28, 30. When passageways 28, 30 are filled, the further addition of fluid creates sufficient hydraulic pressure to force open the tube 4, such that passageways 28, 30 are conjoined as an interior 35 of the tube 4 expanding the tube 4, and ultimately compressing the tube 4 against the surrounding rock of the borehole. See FIG. 3. As a result, main passageway 26 no longer exists. When the tube 4 is fully expanded and no further fluid is received therein, the fluid supply is removed and the fluid is drained. In this manner, the expanded tube 4 frictionally anchors into and/or against the surrounding rock R.

Figure 4:
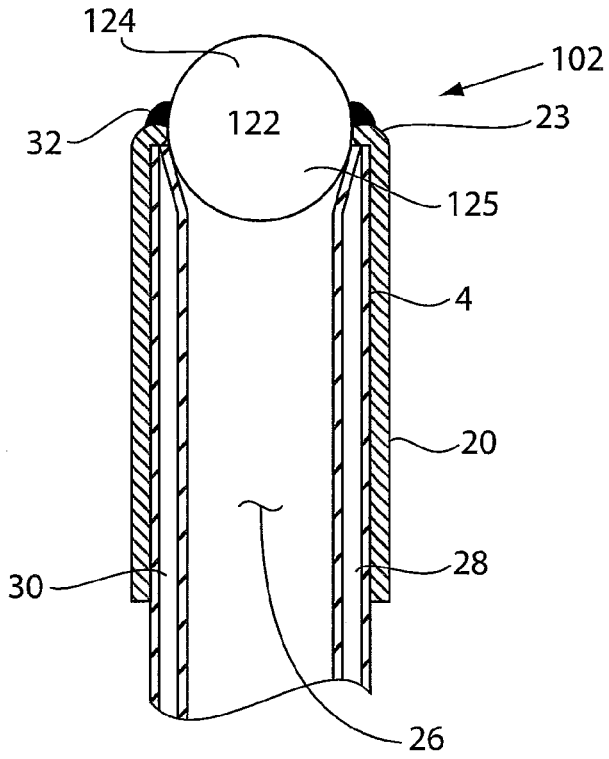
FIG. 4 is a longitudinal cross-section of the distal end of a rock bolt according to one embodiment of the present invention.
Figure 5:
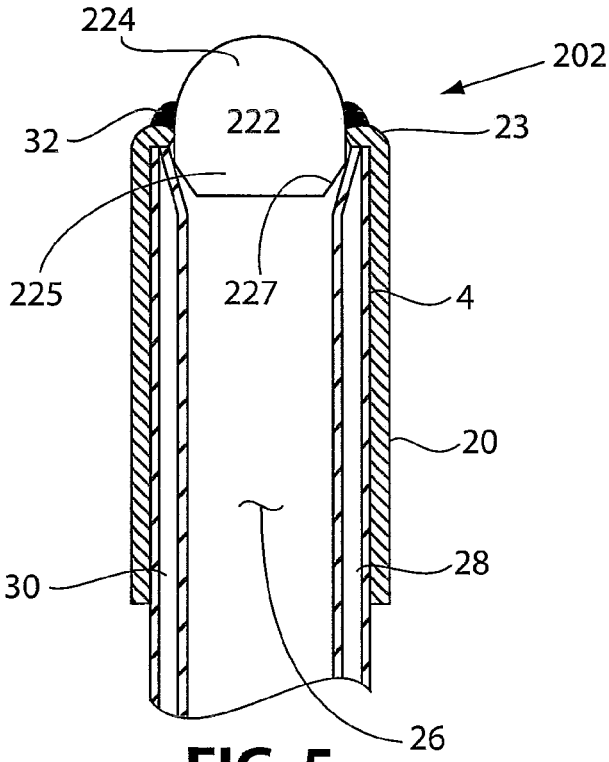
FIG. 5 is a longitudinal cross-section of the distal end of a rock bolt according to a second embodiment of the present invention.

The cover 22 may take the form of a plug or a cap. In one embodiment, the cover 22 is a plug 122 or a plug 222, as shown in FIGS. 4 and 5, respectively. The plug 122, 222 is placed in the opening in the distal end 23 of tube 20 such that a first portion 124, 224 thereof is exposed and a second portion 125, 225 is in the interior of the tube 20. The plug 122, 222 may take any suitable shape (such as rounded) as long as the main passageway 26 is covered. The plug 122, 222 may be made of steel or any other suitable material. The plug 122, 222 may be fixed to the rock bolt 102, 202 by welding or the like. For example, tack welds 32, spaced apart around the circumference of the plug 122, 222 may be used to attach the plug 122, 222 to tube 20.

In one embodiment, such as for rock bolt 102, shown in FIG. 4, plug 122 is spherical. Plug 122 may be placed such that the exposed portion 124 is one hemisphere of spherical plug 122 and the second portion 125 inside the opening in the distal end 23 of second stiffening tube 20 is the other hemisphere as shown. Alternatively, the plug 122 may be placed such that less of plug 122 is exposed or more of plug 122 is exposed as long as the main passageway 26 is covered. Plug 122 may take the form of a polished or unpolished ball bearing.

In another embodiment, rock bolt 202, shown in FIG. 5, the exposed portion 224 of the plug 222 may be dome shaped and the second portion 225 extending into tube 20 may be cylindrical. The second cylindrical portion 225 may further have a beveled edge 227 as shown.

Figure 6:
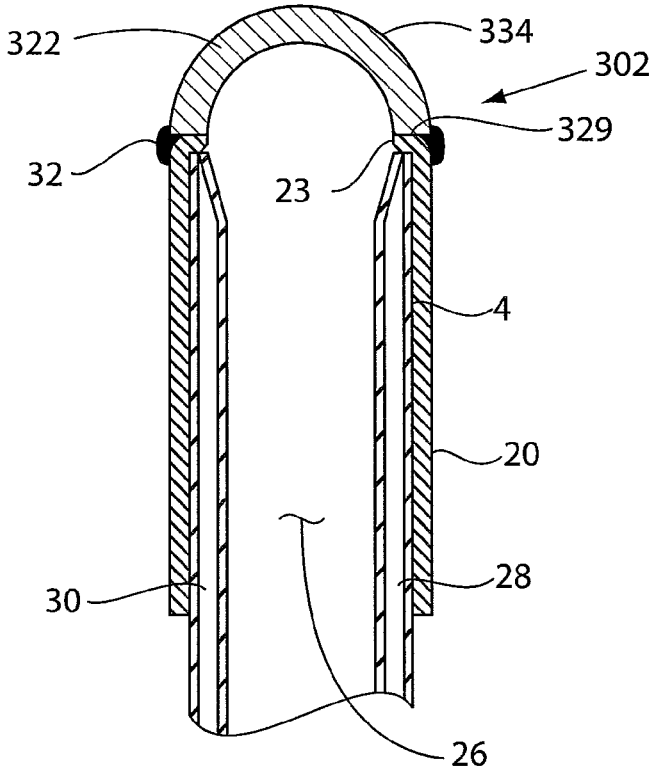
FIG. 6 is a longitudinal cross-section of the distal end of a rock bolt according to a third embodiment of the present invention.
Figure 7:
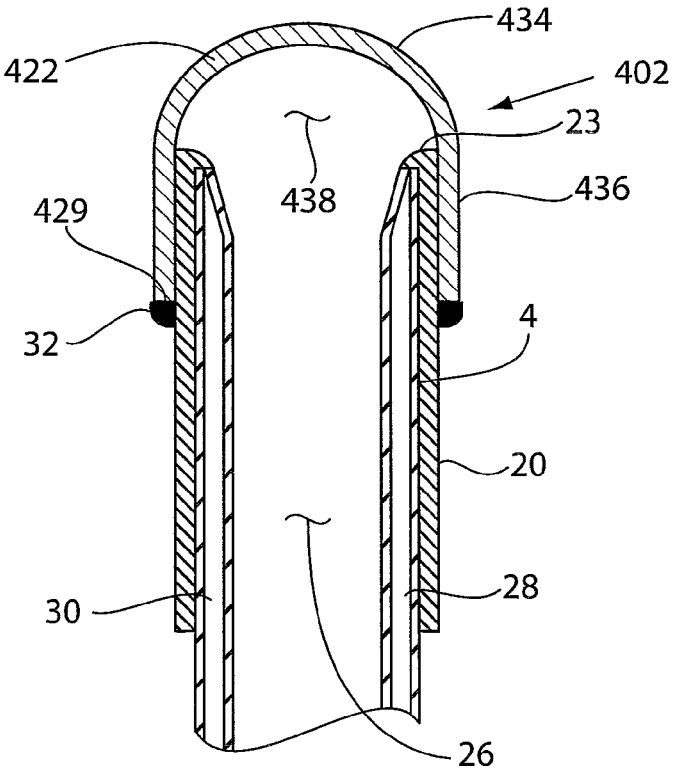
FIG. 7 is a longitudinal cross-section of the distal end of a rock bolt according to a fourth embodiment of the present invention.

Alternatively, the cover 22 may be a cap 322 or a cap 422, as shown in FIGS. 6 and 7, respectively. Cap 322, 422 may take any suitable shape (such as rounded) as long as the main passageway 26 is covered. The cap 322, 422 may be made of steel or any other suitable material. Cap 322, 422 may be fixed to the rock bolt 302, 402 by welding or the like. For example, tack welds 32 spaced apart around the circumference of the proximal end 329, 429 of cap 322, 422 may be used to attach cap 322, 422 to respective tube 20.

In one embodiment, such as for rock bolt 302, shown in FIG. 6, cap 322 is hemispherical, and the open proximal end 329 of cap 322 abuts distal end 23 of tube 20. Cap 322 is shown to be hollow but it could also be solid (not shown), for example, a sphere, such as plug 122 in FIG. 4, cut in half.

In another embodiment, such as for rock bolt 402, shown in FIG. 7, cap 422 has a closed distal end 434, an open proximal end 429, and a sidewall 436 extending from the closed distal end 434 to the open proximal end 429 creating an inner cavity 438. Cap 422 is placed over tube 20 such that tube 20 and the distal end 21 of tube 4 are received in the inner cavity 438. The sidewall 436 of cap 422 extends along the sidewall of tube 20. Cap 422 can be fabricated using any suitable means including, but not limited to, stamping, molding, or attaching a cover portion to a cylindrical tube. The distal end 434 of cap 422 may be hollow (as shown) or may be solid (not shown) as described above for cap 322 of rock bolt 302.

In another embodiment (not shown), cap 422 could be sized such that its sidewall 436 fits inside the distal end 23 of tube 20 such that distal end 434 of cap 422 extends beyond distal end 23 of tube 20. A portion of sidewall 436 may extend beyond the distal end 23 of tube 20 or the length of the sidewall 436 may be adjusted so that only distal end 434 extends beyond distal end 23 of tube 20.

The rock bolt can be made by providing an expandable member which includes an expandable tube 4 and an end fitting (stiffening tube 20) on the distal end 21 of the expandable tube 4. The expandable tube 4 has a longitudinally extending depression 6 disposed between a pair of curved outer portions of the tube 8, 10. The exterior of the tube defines a temporary, enclosed longitudinal passageway 26 having an open distal end 23 and the outer portions of the tube 4 define internal passageways 28, 30 which have closed distal ends 23. The distal end of the tube 4 is then enclosed with a cover so as to cover the distal open end 23 of the temporary, enclosed longitudinal passageway 26. The cover may be in the form of a plug 122, 222 or a cap 322, 422 and may be rounded. The cover may be secured to the expandable member by welding or any other suitable method. The method may also include placing a stiffening tube 20 on a proximal end 15 of the expandable member such that the stiffening tube 20 surrounds the proximal end 15 of the expandable member and has an opening 34 that aligns with a corresponding opening in the expandable tube 4, thereby providing fluid communication to an interior of the expandable tube 4. The stiffening tube 20 may be attached to the expandable member by welding, crimping or any other suitable method.

The cover keeps debris from entering the main passageway of the rock bolt when the rock bolt is in the unexpanded condition. It also allows the rock bolt to be more easily inserted and centered in the borehole. The domed end of the rock bolt created by the cover eliminates the sharp angles at the distal end of the rock bolt which can tend to get caught on the sides of the borehole. The domed end also allows the rock bolt to be centered more easily in the borehole.

The cover also has the advantage of reduced manufacturing costs compared to other methods of rounding the end, for example, building up weld metal on top of a blank to round the end. The cover may be held in place with a minimal number of tack welds as described above simplifying fabrication and reducing costs. In addition, manufacturing becomes even easier when producing a rock bolt according to embodiment 102, shown in FIG. 4. The spherical plug 122 may be placed in tube 20 in any orientation simplifying assembly and, thus reducing assembly time.

The foregoing description sets forth the preferred embodiments of the invention at the present time. Various modifications, additions, and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope. Specifically, while embodiments herein have been described as having a rounded cover, covers having any shape that covers the main passageway of the rock bolt are considered within the scope of the invention.

The invention claimed is:

1. A rock bolt comprising:

an expandable tube that is partially collapsed upon itself so as to form a longitudinally extending depression between two longitudinally extending interior passageways, wherein the longitudinally extending depression forms a temporary main passageway at a distal end of the expandable tube, wherein the two longitudinally extending interior passageways form the interior of the tube upon expansion, wherein the temporary main passageway is open at the distal end of the expandable tube, and wherein the two longitudinally extending interior passageways are closed at the distal end of the expandable tube, wherein a pressurized fluid may be delivered into the two interior passageways to force the depression outward to thereby expand the expandable tube and compress the expandable tube against surrounding rock;

an end fitting attached to the distal end of the expandable tube, the end fitting extending longitudinally beyond the closed distal ends of the interior passageways; and a spherical plug covering the temporary main passageway, wherein the spherical plug is affixed to the end fitting.

2. The rock bolt according to claim 1, wherein the plug is a ball bearing.

3. The rock bolt according to claim 1, wherein a portion of the plug is disposed within an interior of the end fitting and a portion of the plug is disposed outside of the end fitting.

4. A method of manufacturing a rock bolt comprising:

partially collapsing a tube upon itself so as to form a longitudinally extending depression between two longitudinally extending interior passageways, wherein the longitudinally extending depression forms a temporary main passageway at a distal end of the expandable tube;

attaching an end fitting to the distal end of the expandable tube, the end fitting extending longitudinally beyond the closed distal ends of the interior passageways;

closing the two longitudinally extending interior passageways at the distal end of the expandable tube; and covering the temporary main passageway by affixing a spherical plug to the end fitting.

5. The method according to claim 4, wherein the cover plug is a ball bearing.

6. The rock bolt according to claim 4, wherein a portion of the plug is disposed within an interior of the end fitting and a portion of the plug is disposed outside of the end fitting.

7. The method according to claim 4, further comprising placing a stiffening tube on a proximal end of the expandable member, wherein the stiffening tube surrounds the proximal end of the expandable member and has an opening that aligns with a corresponding opening in the expandable tube, thereby providing fluid communication to an interior of the expandable tube.

8. A method of using a rock bolt comprising:

providing a rock bolt comprising:

an expandable tube that is partially collapsed upon itself so as to form a longitudinally extending depression between two longitudinally extending interior passageways, wherein the longitudinally extending depression forms a temporary main passageway at a distal end of the expandable tube, wherein the two longitudinally extending interior passageways form the interior of the tube upon expansion, wherein the temporary main passageway is open at the distal end of the expandable tube, and wherein the two longitudinally extending interior passageways are closed at the distal end of the expandable tube;

an end fitting attached to the distal end of the expandable tube, the end fitting extending longitudinally beyond the closed distal ends of the interior passageways; and a spherical plug covering the temporary main passageway, wherein the spherical plug is affixed to the end fitting;

drilling a borehole in rock;

placing the rock bolt in the borehole;

expanding the tube by providing pressurized fluid to the two interior passageways of the expandable tube, thereby providing frictional engagement between an exterior of the tube and an interior of the borehole; and draining the fluid from the interior of the tube.

9. The method according to claim 8, wherein the plug is a ball bearing.

10. The rock bolt according to claim 8, wherein a portion of the plug is disposed within an interior of the end fitting and a portion of the plug is disposed outside of the end fitting.

* * * * *

UNITED STATES PATENT AND TRADEMARK OFFICE

CERTIFICATE OF CORRECTION

PATENT NO. : 9,062,547 B2
APPLICATION NO. : 13/118678
DATED : June 23, 2015
INVENTOR(S) : Arthur J. Craven et al.

It is certified that error appears in the above-identified patent and that said Letters Patent is hereby corrected as shown below:

In The Claims

Column 5, Line 44, Claim 5, delete “cover plug” and insert -- plug --

Column 6, Line 1, Claim 6, delete “rock bolt” and insert -- method --

Column 6, Line 42, Claim 10, delete “rock bolt” and insert -- method --

Signed and Sealed this
Sixteenth Day of February, 2016

Michelle K. Lee

Michelle K. Lee
*Director of the United States Patent and Trademark Office*